US006711752B2

(12) United States Patent
Smith

(10) Patent No.: US 6,711,752 B2
(45) Date of Patent: Mar. 30, 2004

(54) COVER FOR PROTECTIVE HELMETS AND THE LIKE

(76) Inventor: Joseph Stork Smith, 201 W. Greyhound Pass, Carmel, IN (US) 46032-7006

( * ) Notice: Subject to any disclaimer, the term of this patent is extended or adjusted under 35 U.S.C. 154(b) by 0 days.

(21) Appl. No.: 10/044,139

(22) Filed: Jan. 11, 2002

(65) Prior Publication Data

US 2002/0092086 A1 Jul. 18, 2002

Related U.S. Application Data

(60) Provisional application No. 60/261,553, filed on Jan. 12, 2001.

(51) Int. Cl.[7] ..... A42B 1/24; B65D 33/28

(52) U.S. Cl. ..... 2/422; 383/75; 383/112; 150/154

(58) Field of Search ..... 2/410, 422, 175.6; 383/112, 74, 75; 206/315.9; 150/154

(56) References Cited

U.S. PATENT DOCUMENTS

| | | | | | |
|---|---|---|---|---|---|
| 2,711,234 | A | * | 6/1955 | Rubens | 383/75 |
| 3,155,981 | A | * | 11/1964 | McKissick et al. | 2/422 |
| 5,033,613 | A | * | 7/1991 | Liggett | 206/77.1 |
| 5,197,166 | A | * | 3/1993 | Meier et al. | |
| 5,207,323 | A | * | 5/1993 | McConnell | 150/154 |
| 5,529,395 | A | * | 6/1996 | French | 383/75 |
| 5,743,458 | A | * | 4/1998 | French | 150/154 |
| 5,922,437 | A | * | 7/1999 | Bryant | 150/154 |
| 6,061,836 | A | * | 5/2000 | Peters | 2/175.6 |
| 6,176,408 | B1 | * | 1/2001 | Miner et al. | 224/653 |
| 6,233,738 | B1 | * | 5/2001 | Siracusa | 2/4 |

FOREIGN PATENT DOCUMENTS

| | | | | |
|---|---|---|---|---|
| DE | 29512687 U1 | * | 3/1997 | A42B/1/18 |
| DE | 29617585 U1 | * | 4/1997 | A42B/3/04 |
| GB | 2031375 A | * | 4/1980 | B65D/30/06 |
| WO | WO 92/19116 | * | 11/1992 | |

* cited by examiner

*Primary Examiner*—Rodney M. Lindsey
(74) *Attorney, Agent, or Firm*—Woodard, Emhardt, Moriarty, McNett & Henry LLP

(57) ABSTRACT

An cover for protecting a helmet, such as a motorcycle or sports helmet, including a substantially circular material portion having an outer periphery, a first open tube end positioned on the outer periphery, a second open tube end positioned on the outer periphery substantially adjacent the first open tube end and a hollow tube portion extending along the outer periphery from the first open tube end to the second open tube end. A first drawstring end extends from the first open tube end and a second drawstring end extending from the second open tube end with a drawstring extending through the hollow tube portion between the first drawstring end and the second drawstring end. The cover is adapted to wick moisture therethrough to minimize the risk of mildewing of an enclosed helmet. The drawstring and hollow tube portion defining an opening for insertion of the helmet into the cover, wherein the size of the opening is inversely related to the extension of the drawstring from the open ends.

11 Claims, 2 Drawing Sheets

COVER FOR PROTECTIVE HELMETS AND THE LIKE

REFERENCE TO RELATED APPLICATION

This utility patent application is based on U.S. provisional patent application Ser. No. 60/261,553, filed Jan. 12, 2001 and claims priority thereto.

TECHNICAL FIELD OF THE INVENTION

The present invention generally relates to items constructed from fabric and, more particularly, to a cover for protective helmets and the like.

BACKGROUND OF THE INVENTION

As is widely known, protective helmets, such as the helmet 10 illustrated in FIG. 1, are utilized in a variety of activities in order to protect the wearer from head trauma injuries. For example, protective helmets 10 are commonly used by persons engaged in skiing, snowboarding, bicycling, motorcycling, auto racing, football, hockey, and other activities in which there is a reasonably high likelihood of head trauma injuries if the head is not protected in some way.

Although such helmets 10 are designed to protect the wearer's head in case of an impact, it is not uncommon for such helmets 10 to be decorated on their exterior surfaces in order to have a pleasing appearance or to allow the wearer to be readily identified at a distance. Therefore, although the helmet 10 is designed to absorb the force of an impact in the event of a crash, most owners of helmets 10 do not expect to be involved in such crashes during the normal course of their activities, and therefore they generally desire to keep the helmet 10 in an attractive, unblemished condition. Moreover, many helmets 10 include transparent visors 11 that become opacified if abraded. Such abrasion can interfere with the wearer's vision, thus becoming a safety hazard. Therefore, it is important to keep the helmet visor 11 unabraded and transparent.

Maintaining the helmet 10 in an unblemished condition is made difficult by the fact that the helmet 10 is rather bulky and is not easily stored during periods of non-use, including transport to and from the activity where the helmet 10 may be required, and during breaks in the activity (during which most wearers do not wish to leave the helmet 10 upon their heads). It has therefore been found that the decorative exterior surface of the helmet 10 will generally become marred and damaged over time due to coming into contact with other objects during such storage and transport. Such damage can also have an effect upon the impact absorption performance of the helmet 10, as well as abrasion of the transparent visor 11 surface. Most manufacturers of helmets 10 caution that the helmet 10 should not be worn if the surface has been damaged, as the structural integrity of the helmet 10 may have been compromised.

Helmet covers are currently used to protect helmets 10 from damage. The known covers, while adequate to protect the helmets 10 from wear and tear, suffer from a number of shortcomings. For example, currently known helmet covers include those made from leather or vinyl, often with a faux-fur or wool lining. These covers are nearly as heavy and as bulky as the helmet 10 they cover and present a storage problem when not in use. Further, these covers are difficult to clean and dry, such that they retain moisture and readily mildew once they become wet.

Nylon helmet covers are not as heavy and/or bulky as their leather and vinyl counterparts, but instead tend to bag around the helmet 10 such that they are readily snagged and torn. Further, a spare motorcycle helmet 10 with a nylon cover has a tendency to flap in the wind, generating a distracting nuisance to the motorcycle operator.

Moreover, none of the above-mentioned helmet covers stretch appreciably and are only more or less form-fitting. The known covers therefore must be tailored to the dimensions and shape of the helmet to which with which they are to be used, and are difficult, if not impossible, to use with non-standard sized or shaped helmets.

There is therefore a need for a lightweight and readily stored form-fitting device which will allow a protective helmet to be transported and stored in a convenience manner while protecting the surface thereof from accidental damage. The present invention is directed towards meeting this need.

SUMMARY OF THE INVENTION

The present invention relates to a protective cover for a motorcycle or sports helmet and a method for protecting such a helmet. The method for protecting the helmet includes the steps of first providing an enclosure including a substantially circular material portion having an outer periphery, a hemmed tube portion extending along the outer periphery and having a first open end and a second open end positioned substantially adjacent the first open end, and a drawstring having a first drawstring end and a second drawstring end and extending through the hemmed tube portion. The first and second drawstring ends extend from the respective first and second open ends. The hemmed tube portion defines an opening having a variable size and the size of the opening is inversely related to the extension of the drawstring from the open ends. Next, the size of the opening is increased. Then, a helmet is inserted through the opening into the enclosure, followed by decreasing the size of the opening. Finally, the enclosure is stretched around the helmet such that the enclosure is substantially form fitting to the helmet. Once the helmet is inside the enclosure, the enclosure is adapted to wick moisture away from the helmet.

One object of the present invention is to provide an improved method and apparatus for storing a helmet. Related objects and advantages of the present invention will be apparent from the following description.

DESCRIPTION OF THE PREFERRED EMBODIMENTS

Figure 1:
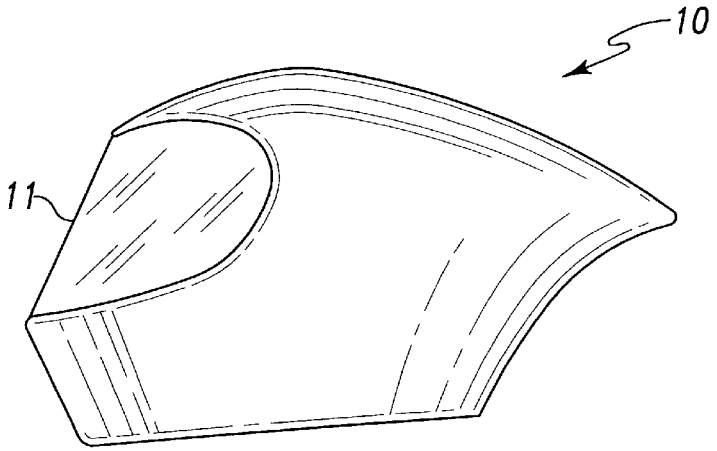
Fig. 1 (PRIOR ART)
FIG. 1 is a side elevational view of a typical prior art helmet.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein are herein contemplated as would normally occur to one skilled in the art to which the invention relates.

Figure 2:
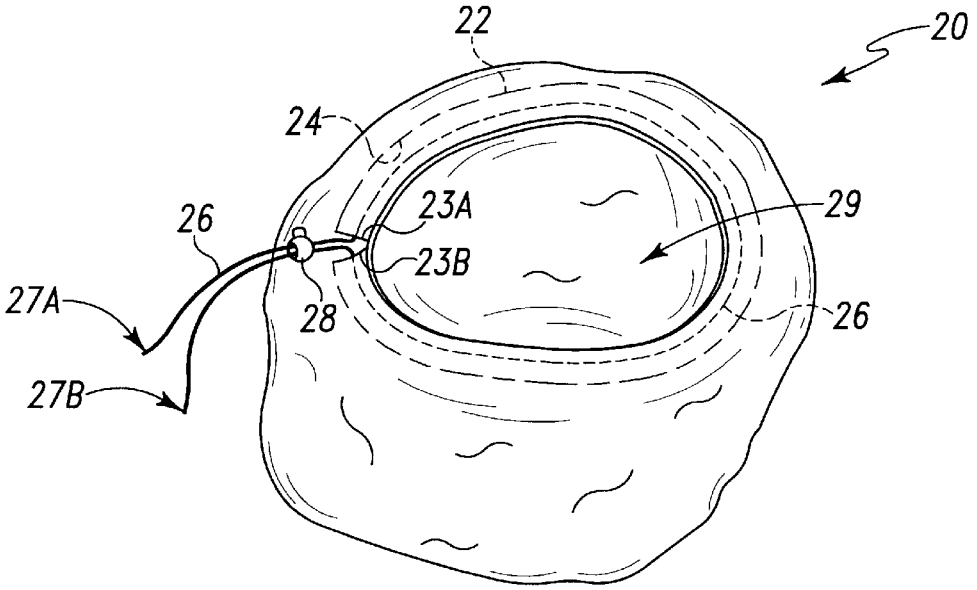
FIG. 2 is a perspective view of a first embodiment cover of the present invention.

In order to protect a helmet 10 during transport and/or storage, the present invention provides for a cover as illustrated in FIG. 2, and generally indicated at 20. The first embodiment cover 20 is formed from fabric or other pliable material and is preferably formed from a single piece of fabric cut into a generally circular shape, preferably with a hemmed diameter of about 24 inches. In a preferred embodiment, the fabric from which the cover 20 is formed is preferably 88 percent nylon and 12 percent spandex, having a weight of approximately 6 ounces per square yard and a stretch of 104 percent lengthwise and 75 percent widthwise. Preferably, the weight of the helmet cover 20 is about 3 ounces. Also preferably, the fabric is readily compressible and may be carried and a helmet cover made therefrom may be carried unobtrusively in a pocket. Also, the fabric has sufficient porosity such that moisture may easily pass therethrough. Preferably, the moisture is passed through the fabric by a wicking mechanism, or, in other words, the fabric "breathes". Since the fabric preferably includes a substantial mount of spandex, it is resistant to tearing, even if penetrated. Also preferably, the fabric has a relatively low surface coefficient of friction, making it resistant to soiling.

The edge of the circular piece of fabric is folded over and stitched at 22 in order to form an enclosed tube or channel 24. A drawstring 26 is then fed through the channel 24 such that one end of the drawstring 26 emerges from each end of the channel 24. In the first embodiment, a spring-loaded closure 28 is placed over the ends of the drawstring 26. The closure 28 can be freely slid upon the drawstrings 26 when a button thereupon is depressed, and will resist movement along the drawstring 26 when the button is released.

Figure 3:
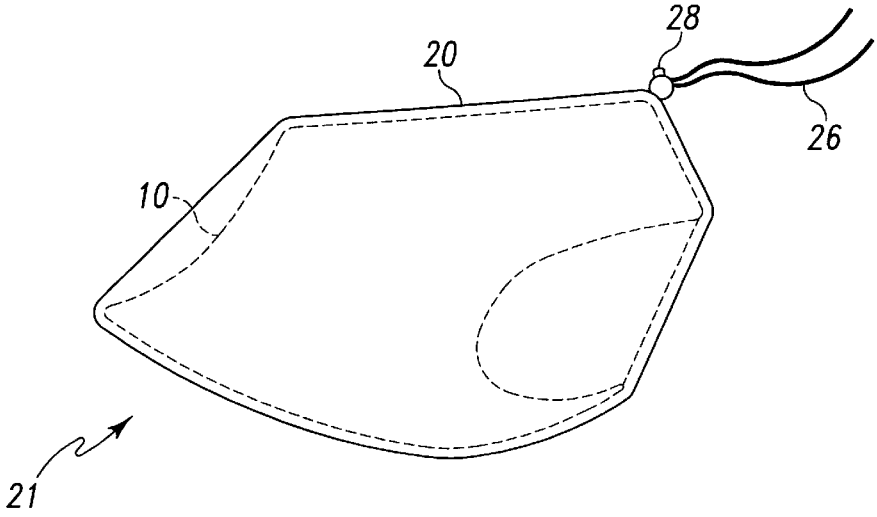
FIG. 3 is a side elevational view of the first embodiment of the present invention enclosing the helmet of FIG. 1.
Figure 4:
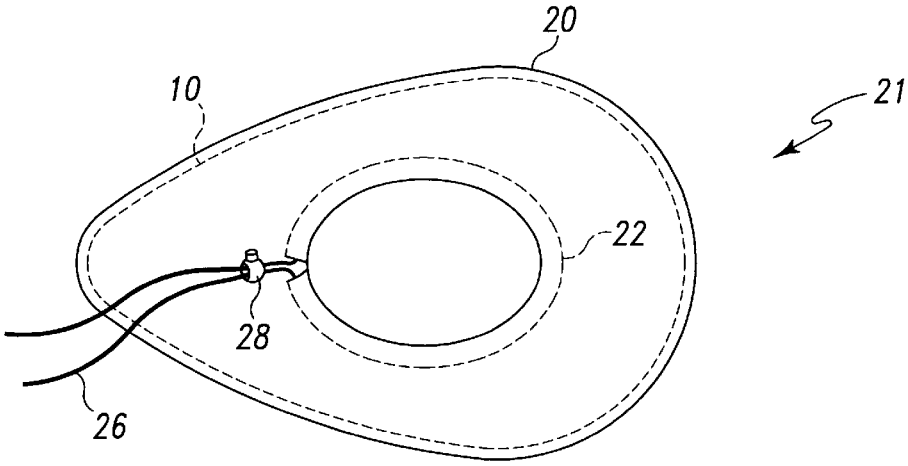
FIG. 4 is a top plan view of the first embodiment of the present invention enclosing the helmet of FIG. 1.

With reference to FIG. 3, the helmet 10 may be placed within the cover 20 and the drawstring 26 may be pulled taught such that the cover 20 snugly conforms to the contours of the helmet 10, such that it is resistant to snagging or flapping. Once the drawstring 26 has been pulled taught, the spring-loaded closure 28 may be slid upon the drawstring 26 to a point adjacent the openings of the channel 24. This will maintain the drawstring in its pulled condition such that the cover 20 remains tightly pulled about the helmet 10. Once this has been done, the ends of the drawstring 26 may be placed into the interior of the helmet, if desired. The assembly 20/helmet 10 is shown from the top perspective in FIG. 4.

It will be appreciated from the above description that the cover of the present invention provides a convenient means for protecting a helmet 10 while the helmet is being stored or transported. Because the fabric is pliable, it forms to the contours of the helmet 10 when the drawstring 26 is pulled taught. In the preferred embodiment which utilizes fabric having a stretch ability, the cover 20 is able to conform quite precisely to the contours of the helmet 10, reducing the likelihood of snagging or flapping. Also, because the fabric breathes, a helmet 10 may be encased therein for extended periods of time without mildewing.

In operation, the cover 20 is used to protect a helmet 10 by providing an enclosure 21 including a substantially circular material portion 21 having an outer periphery 22, a hollow tube portion 24 extending along the outer periphery 22 and having a first open end 23A and a second open end 23B positioned substantially adjacent the first open end 23A, and a drawstring 26 having a first drawstring end 27A and a second drawstring end 25B and extending through the hollow tube portion 24, wherein the first and second drawstring ends 27A, B extend from the respective first and second open ends 23A, B, wherein the hollow tube portion 24 defines an opening 29 having a variable size, and wherein the size of the opening 29 is inversely related to the extension of the drawstring 26 from the open ends 23A,B. When the drawstring ends 27A, B are pulled tight, the opening 29 contracts with the tube portion 24 bunching up along the remaining enclosed portion of the drawstring 24. To insert the helmet 10 into the enclosure 21, the size of the opening 29 is first increased by pulling on the opening 29 or otherwise increasing the length of the portion of the drawstring 24 enveloped within the hollow tube portion 24. The helmet 10 is then inserted through the opening 29 into the enclosure 21. Insertion of the helmet 10 is readily accomplished since the cover 20 is pliable and easily stretched. After the helmet 10 is in the enclosure 21, the size of the opening 29 is (such as by pulling the drawstring ends 27A, B) and the cover 20 (and the enclosure 21) is stretched around the helmet 10 such that the cover 20 is snug around the helmet 10 and the enclosure 21 is therefore substantially form fitting to the helmet 10. The porous nature of the cover 20 allows the enclosure 21 to efficiently wick moisture from the helmet 20, minimizing the risk of mildew of the helmet 10 once enclosed and allows for long term storage of the enclosed helmet 10. Since the cover 20 is made of a tear-resistant and pliable material, the presence of the cover 20 over the helmet protects the helmet 10 (and visor 11, if any) from scuffing, scratching, and other impact damage that might otherwise befall the helmet 10. This is especially true of the visor 11, since when unprotected the visor 11 may be easily scuffed, scratched and/or otherwise abraded, resulting in a decrease in its transparency and safe utility.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method for protecting a helmet, comprising the steps of:

a) providing an enclosure including a substantially circular material portion having an outer periphery, a hemmed tube portion extending along the outer periphery and having a first open end and a second open end positioned substantially adjacent the first open end, and a drawstring having a first drawstring end and a second drawstring end and extending through the hemmed tube portion, wherein the first and second drawstring ends extend from the respective first and second open ends, wherein the hemmed tube portion defines an opening having a variable size, and wherein the size of the opening is inversely related to the extension of the drawstring from the open ends;

b) increasing the size of the opening;

c) inserting a helmet through the opening into the enclosure;

d) decreasing the size of the opening;

e) stretching the enclosure around the helmet such that the enclosure is substantially form fitting to the helmet;

f) tightening the enclosure around the helmet using the first and second drawstring ends from a bottom-side of the helmet; and g) wherein the enclosure is adapted to wick moisture from the helmet therethrough.

2. The method of claim 1 further comprising the steps of:

h) enlarging the opening;

i) removing the helmet from the enclosure; and j) compressing the enclosure to a volume of less than about 12.6 cubic inches.

3. The method of claim 1 wherein the enclosure weighs about 3 ounces.

4. The method of claim 1 wherein the enclosure includes about 88 weight percent nylon and about 12 weight percent spandex.

5. The method of claim 1 wherein the substantially circular material portion has a diameter of about 24 inches.

6. An enclosure for protecting a helmet, comprising:

a substantially circular material portion having an outer periphery;

a first open tube end positioned on the outer periphery;

a second open tube end positioned on the outer periphery substantially adjacent the first open tube end;

a hollow tube portion extending along the outer periphery from the first open tube end to the second open tube end;

a first drawstring end extending from the first open tube end;

a second drawstring end extending from the second open tube end; and a drawstring extending through the hollow tube portion between the first drawstring end and the second drawstring end;

wherein the enclosure is adapted to wick moisture therethrough;

wherein the hollow tube portion defines an opening having a variable size;

wherein the size of the opening is inversely related to the extension of the drawstring from the open ends; and wherein the enclosure is adapted to substantially form fittingly receive a helmet, said enclosure being further adapted to be tightened using the first and second drawstring ends on a bottom-side of the helmet, thereby leaving an opening on the bottom-side of the helmet.

7. The enclosure of claim 6 wherein the enclosure weighs about 3 ounces.

8. The enclosure of claim 6 wherein the circular material portion includes about 88 weight percent nylon and about 12 weight percent spandex.

9. The enclosure of claim 6 wherein the substantially circular material portion has a diameter of about 24 inches.

10. The enclosure of claim 6 wherein the substantially circular material portion has a stretch of 104 percent lengthwise and 75 percent widthwise.

11. The enclosure of claim 6 further comprising a closure operationally connected to the drawstring ends and operable to restrict movement of the drawstring through the hollow tube portion.

* * * * *